US006739158B2

(12) United States Patent
Sciacca

(10) Patent No.: US 6,739,158 B2
(45) Date of Patent: May 25, 2004

(54) METHOD AND APPARATUS FOR PRODUCING AUTOMATICALLY SHAPED TUBULAR KNITWEAR ITEMS WITH GRADUATED ANATOMIC SUPPORT AND CONTROL AND PRODUCTS OBTAINED THEREBY

(76) Inventor: Franco Sciacca, Via Veneto, 18, 22070 Cassina Rizzardi (Como) (IT)

( * ) Notice: Subject to any disclaimer, the term of this patent is extended or adjusted under 35 U.S.C. 154(b) by 0 days.

(21) Appl. No.: 10/203,827

(22) PCT Filed: Feb. 19, 2001

(86) PCT No.: PCT/IT01/00075

§ 371 (c)(1),
(2), (4) Date: Aug. 12, 2002

(87) PCT Pub. No.: WO01/61094

PCT Pub. Date: Aug. 23, 2001

(65) Prior Publication Data

US 2003/0019252 A1 Jan. 30, 2003

(30) Foreign Application Priority Data

Feb. 21, 2000 (IT) ..... CO2000A0005

(51) Int. Cl.[7] ..... D04B 9/00
(52) U.S. Cl. ..... 66/8

(58) Field of Search ..... 66/8, 17, 19, 81, 66/173, 178 R, 189, 182, 183, 184, 185, 60 R, 77, 76

(56) References Cited

U.S. PATENT DOCUMENTS

| | | | | | |
|---|---|---|---|---|---|
| 3,425,246 | A | * | 2/1969 | Knohl | 66/171 |
| 5,519,894 | A | * | 5/1996 | Imboden et al. | 2/409 |
| 5,987,933 | A | * | 11/1999 | Metzler | 66/202 |
| 6,196,030 | B1 | * | 3/2001 | Stoll et al. | 66/178 R |
| 6,460,380 | B1 | * | 10/2002 | Sciacca et al. | 66/21 |

* cited by examiner

*Primary Examiner*—Danny Worrell
(74) *Attorney, Agent, or Firm*—James B. Conte; Barnes & Thornburg

(57) ABSTRACT

The invention relates to tubular knitwear items (1) suitably shaped or modeled without the usual cutting/sewing operations, characterized by dimensionally little or non elastic fabric zones, said zones being structurally and functionally connected as a textile frame for anatomic support and control. According to the jacquard design and to the work cycle of the textile machine, the invention enables the production of differentiated-growth fabric in specific areas or zones by means of the programmed exclusion of stitches or knitted courses and the simultaneous production of exceeding stitches or three-dimensional inner frills (Bi), structurally having lower elasticity, thus also obtaining a programmed deformation of the knitted tube.

26 Claims, 3 Drawing Sheets

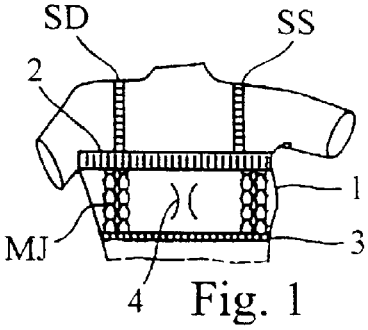
Fig. 1
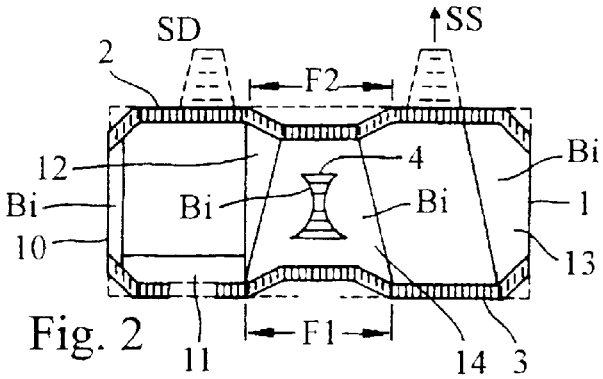
Fig. 2
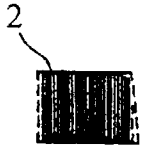
Fig. 3b
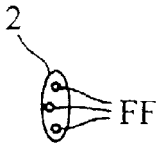
Fig. 3c
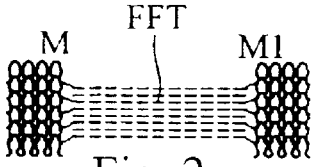
Fig. 2a
Fig. 3
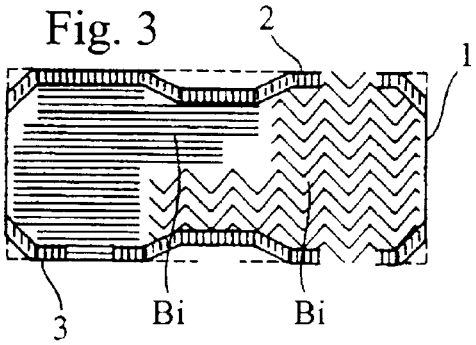
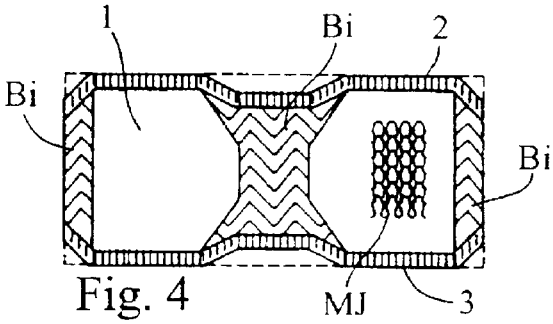
Fig. 4
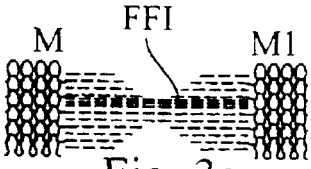
Fig. 3a
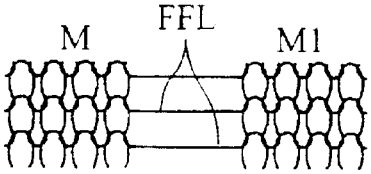
Fig. 4a
Fig. 5
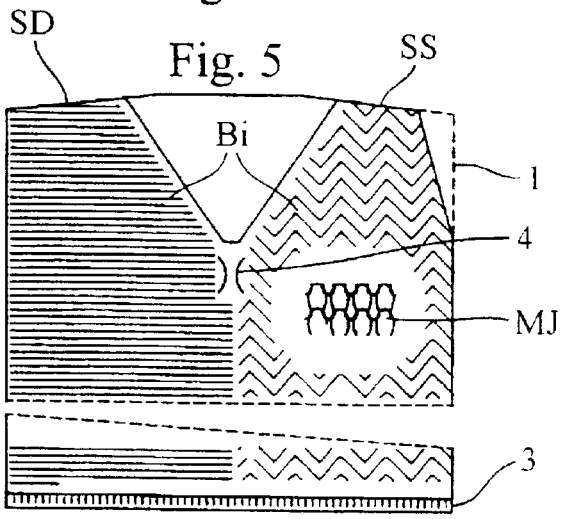
Fig. 6
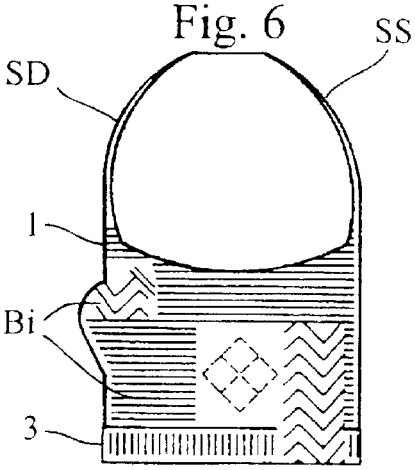

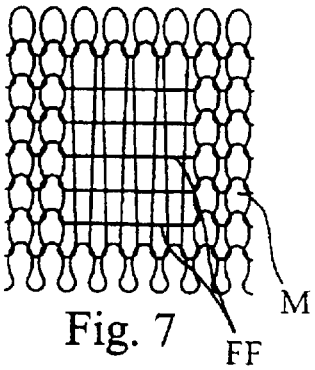
Fig. 7
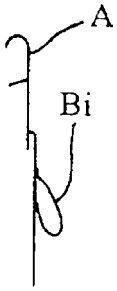
Fig. 8a
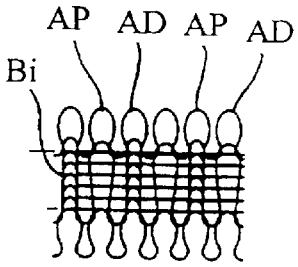
Fig. 8
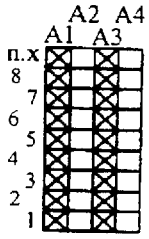
Fig. 9
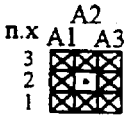
Fig. 11
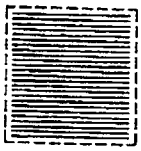
Fig. 8c
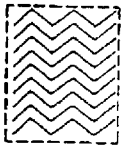
Fig. 8b
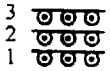
Fig. 11a
Fig. 12
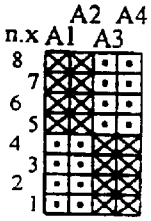
Fig. 10
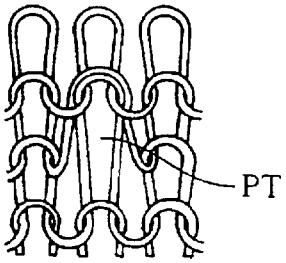
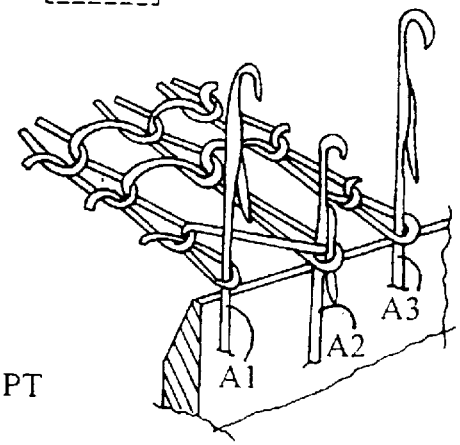
Fig. 13
Fig. 17
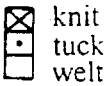
Fig. 14
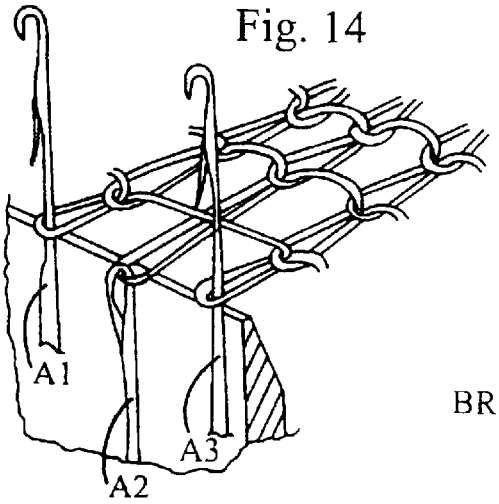
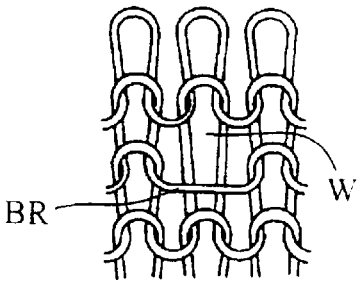
Fig. 15
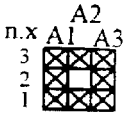
Fig. 16
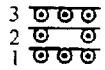
Fig. 16a

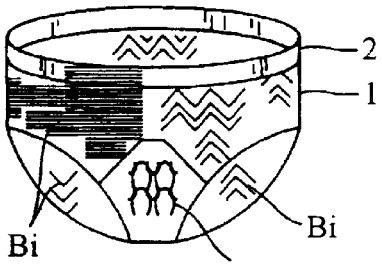
Fig. 18
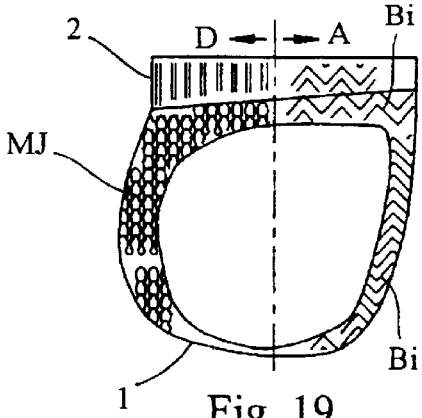
Fig. 19
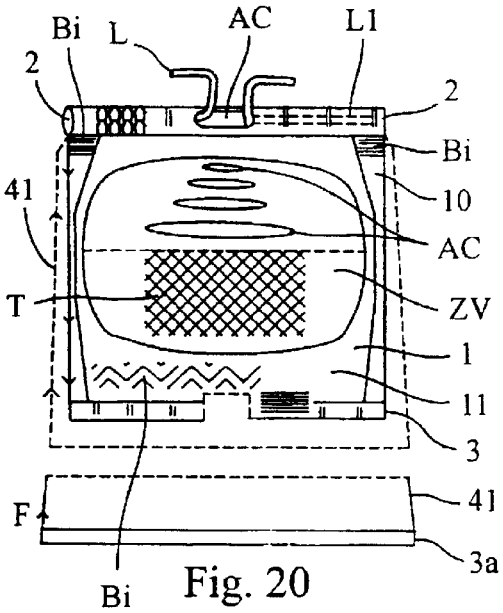
Fig. 20
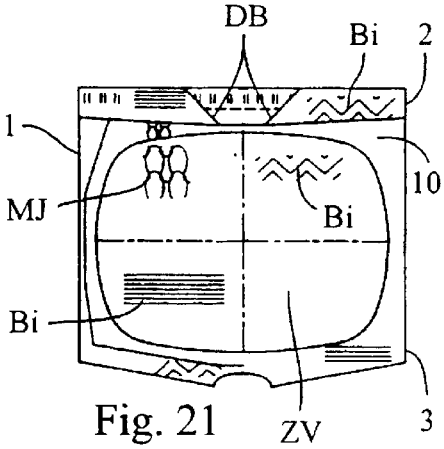
Fig. 21
Fig. 22
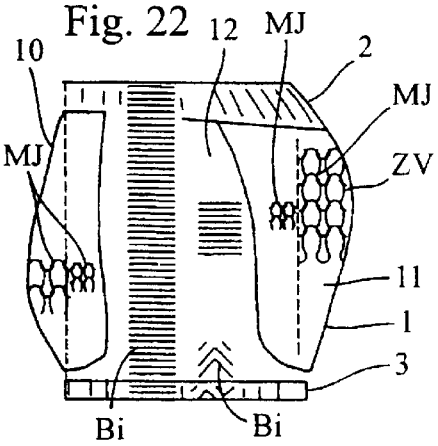
Fig. 23
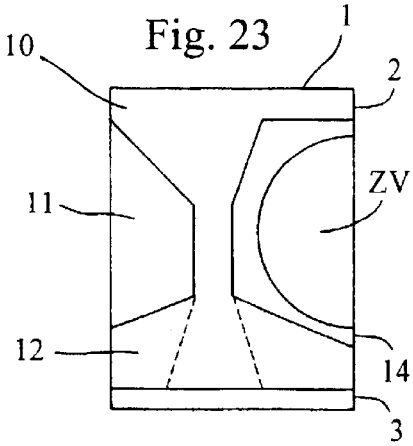

METHOD AND APPARATUS FOR PRODUCING AUTOMATICALLY SHAPED TUBULAR KNITWEAR ITEMS WITH GRADUATED ANATOMIC SUPPORT AND CONTROL AND PRODUCTS OBTAINED THEREBY

TECHNICAL FIELD

The introduction of "full electronic" circular knitting machines with differentiated diameters has attracted the knitting industry's interest since the versatility of these machines allows to produce a wide range of semi-finished tubular items, such as for instance bras, brassieres, pants, dresses, trousers, skirts, teddies, swimsuits, technical items, and more.

From the technical-textile point of view said items are obviously characterized by a high intrinsic elasticity, a peculiar feature of jersey fabric, and therefore it is sometimes difficult, if not impossible, to design manufactured items in general, pants and bras in particular, which can support the concerned anatomic portions satisfactorily. In practice, textile items such as pants and bras, characterized by a general or partial, even graduated, compression, control and support, are normally manufactured with a plurality of traditional woven fabrics or anyway dimensionally highly stable fabrics, the latter being a necessary condition for their commercial success. With usual circular machines for weft knitwear, both linear and circular, it is particularly difficult to introduce and coordinate automatically and selectively parts or areas of highly elastic fabric, such as jersey or products obtained from it, with other zones of dimensionally stable fabric, therefore substantially stiff, having functions of anatomic prop or support as in the case of bras. The possible presence of shoulder straps has little or no relevance, since the pulling or upper support effect is obviously reduced or eliminated by the intrinsic elasticity of the jersey fabric. This manufacturing difficulty makes the production cycle more complex and expensive, since it obliges knitwear manufacturers to introduce, according to the situation, different dimensionally stable fabrics, or further cutting and sewing operations are necessary to this purpose, i.e. additional operations continuously and permanently affecting general production costs.

AIMS OF THE PRESENT INVENTION

The present invention aims at reducing to a high extent or at wholly eliminating some of the above-mentioned technical and manufacturing limitations, so as to produce automatically tubular knitwear items without longitudinal seams, suitably shaped, having a sufficient capacity of autocontainment and anatomic support for specific portions, with original economical, technical, aesthetic and commercial purposes.

All this stated, a main aim of the present invention consists in providing a method and apparatus for the production of suitably shaped tubular items, preferably produced with the continuous motion of the needle cylinder, provided with dimensionally more stable fabric areas, structurally and functionally connected to control and support together the concerned anatomic portions.

A further aim consists in providing a method for the production of tubular items, equipped with one or more dimensionally more stable fabric areas, structurally and functionally connected to control and support, also individually, the concerned anatomic portions.

An additional aim consists in providing a method for the production of the above-mentioned tubular items, characterized by fabric areas which are made dimensionally more stable by using and suitably arranging three-dimensional inner frills.

Another main aim consists in providing a method and apparatus for producing tubular items made of at least two concentric layers or fabrics, continuously produced, both connected to at least a common—also double—welt, produced both using the dial or other needle bed, and by selecting alternated needles.

An additional aim consists in providing a method and apparatus for producing items such as pants and bras in particular, with areas of dimensionally more stable fabric, structurally connected as a textile frame to create or improve general or specific shaping or anatomic control features.

Further aims will be evident from the description, examples and accompanying drawings, per se or in combination, beyond the final claims.

DISCLOSURE OF THE INVENTION

The above mentioned aims are substantially achieved by a method and apparatus for producing automatically shaped tubular knitwear items with graduated anatomic support and control, and products obtained thereby, according to the appended claims.

The features of the invention and the advantages deriving thereof are more evident thanks to the following non limiting description of embodiments provided by way of examples, which can be advantageously applied to the majority of knitting machines, circular machines in particular.

BRIEF DESCRIPTION OF THE DRAWINGS

The description will be made with reference to the accompanying drawings in which:

FIG. 1 shows a tubular bra produced according to the prior art;

FIG. 2 shows a bra with shoulder straps structurally and functionally connected to stiffened underlying zones;

FIGS. 3, 4, 5 and 6 show different knitwear items produced according to the present invention, characterized by a large plurality of differently placed frills Bi.

FIGS. 2*a*, 3*a* and 4*a* schematically show some applications of floating yarns, variously manipulated and knitted;

FIG. 3*b* is a front view of the double welt 2 of FIG. 3 having one or more floating yarns automatically introduced between the two layers of fabric;

FIG. 3*c* is a section view the double welt 2 of FIG. 3*b;*

FIG. 7 shows a fabric with a central zone having floating yarns FF;

FIG. 8 is a front view of a fabric having frills Bi made only with odd needles AD, with even needles AP not operating;

FIG. 8*a* shows a needle A, usually housed within the bed or cylinder (not shown), on whose stem the underlying fabric and the inner frill Bi are still engaged;

FIGS. 8*b* and 8*c* schematically show respectively a diagonal and an horizontal arrangement of frills Bi;

FIG. 9 technically shows the technical pattern for the production of the three-dimensional knit frills Bi;

FIG. 10 technically shows the technical pattern for the production of a so-called "embossed" or cellular knitted structure, with an alternated and prolonged sequence of tuck stitches;

FIGS. 11 and 11*a* show the technical pattern for the production of a single "tuck stitch" PT;

FIG. 12 shows a tuck stitch PT within a knitted structure;

FIG. 13 is a perspective view of the needles carrying out the sequences for the production of a "tuck stitch";

FIG. 14 is a perspective view of the needles starting the sequences for the production of knit frills Bi, by weaving a single "bridle";

FIG. 15 shows a single "bridle" BR within a knitted structure;

FIGS. 16 and 16*a* show the technical pattern for the production of a single "bridle" BR;

FIG. 17 is a technical key for the patterns of FIGS. 9, 10, 11, 16;

FIG. 18 shows a pant 1 produced according to the present invention;

FIG. 19 is a section view of pants 1;

FIG. 20 shows a garment 1 suitable for pregnant women, consisting of two continuously produced concentric fabrics;

FIG. 21 shows a knitwear item with wide zones of stiffer fabric;

FIG. 22 is a side view of pants 1;

FIG. 23 is a schematic section view of a preliminary plan for a possible manufactured item 1.

DESCRIPTION OF THE ILLUSTRATIVE EMBODIMENTS

In the example known from the prior art shown in FIG. 1, the bra or brassiere 1 made of jersey fabric, provided with upper and lower double welts 2 and 3, with inner frills Bi suitable to shape anatomically the central part of the breast 4, thus covering but not supporting. Additional shoulder straps SD-SS keep but do not support, since, as is known to the person skilled in the art, the elastic jersey fabric MJ which is present between welts 2 and 3, has an efficient textile cushion effect.

What happens is that the typical feature of jersey fabric, i.e. elasticity, clashes technically with the production of some knitwear items normally characterized by dimensionally much more stable fabric areas, such as bras and pants, athletic sportswear or other manufactured items suitable for supporting or compressing in a programmed and satisfying way anatomic portions such as for instance breasts, glutei, abdomen.

Another specific limitation consists in that, differently from traditional bras, characterized by one or more zones of woven or stiff fabric, especially in the central zone, under and between the breasts, said brassiere 1 is provided with the usual welts 2 and 3, which are elastic in all their annular extension.

In a first preferred embodiment the invention is firstly carried out by preparing a work cycle and jacquard design, i.e. direct or precluded inputs to needles by means of a suitable graphics workstation and/or control devices or other similar means suitable to said purpose. The manufactured item 1 of FIG. 3, after the usual knitting start, goes on with the double welt 2, obtained with a fixed selection of alternated needles, for instance the odd ones, to produce knitted fabric characterized by fabric zones with differentiated growth due to the exclusion of a given number of needles, alternated with respect to the adjacent ones, for instance 1:1, or 2:1–2:2 and the like. Unusually, during the knitting process, both of the welt 2 and beyond, a great part of inputs or commands usually directed to the needles is not sent to a part of the latter, following a given pattern or program according to the original design.

This results in the exclusion of the needles without inputs or commands from the knitting process; said exclusion, if total and related to specific zones, produces floating yarns FF of FIG. 7 instead of the knitted fabric M. Said floating yarns FF are then handled by means of a small number of operating needles A, FIG. 8, suitably spaced, with the double purpose of reducing the length of floating yarns and of building interesting knitted structures, that is to say the inner three-dimensional frills Bi, FIG. 8. Therefore, the invention is technically carried out both by using said free floating yarns FFL in FIG. 4*a*, or tuck floating yarns FFT as in FIG. 2*a* or laid-in floating yarns FFI as in FIG. 3*a*, for some embodiments, and by transforming them into knitted fabric, the latter being produced only with a part of the needles which are present in the concerned areas or zones, such as Bi of FIG. 8.

For instance only even needles AP, FIG. 8, will be excluded, or alternated pairs of needles; i.e. three-needle operating groups followed by one or more excluded needles, and so on. The simultaneous presence of operating needles alternated with excluded needles, FIGS. 8–9–14, in specific zones and for an even relatively long time (corresponding to a large number of knitted courses, FIGS. 8–9), is the sufficient and necessary condition for the manufacture of an original three-dimensional knitted fabric, built by operating needles and corresponding loops AD, though interrupted and still crossed to excluded needles and loops AP, FIG. 8, so as to produce the closed knitted frill (or open knitted frill, according to the situation) with two ply fabric or cloths Bi, FIG. 8, within the usual knitted tube TM. Such fabric growth or additional inner frill Bi is characterized on the front side of the knitted fabric by a perfect seam due to the stretching of the loops or stitches of non-operating needles AP, which are therefore excluded from the knitting process of said frill Bi, whose height and width are repeatable or variable. Said three dimensional frills Bi, structurally with a low elasticity, are particularly efficient in horizontal and diagonal directions; therefore, if suitably placed and repeated, they can show two important results: they increase the support of anatomic portions such as for instance breast, abdomen, glutei and they also substantially modify the aesthetic appearance of jersey fabric, a new and important result from the aesthetic and commercial point of view. After completing said double welt 2 by releasing the dial jacks (not shown) or seaming stitches with the operation of previously excluded needles, for instance the even ones, the knitting process goes on for a suitable number of knitted courses up to the production of the second welt 3 and the final waste, or vice versa. In short, the manufactured item 1 of FIG. 3 is strongly characterized by horizontal or diagonal inner frills Bi, whose structure and weave cause a general stiffening of said manufactured item, which is certainly reactive to the stresses resulting from the presence of shoulder straps such as SS-SD in FIG. 1, the latter, as described, having an important function of anatomic support. Within the aims of the invention there is also the general or partial stiffening of at least a double welt, 2 or 3, also obtained by means of yarns further introduced during the production of the double welt by the dial jacks (or needles belonging to other beds, not shown), as schematically shown in FIG. 3*b*.

The usual welt 2 contains floating yarns FF whose origin, quality and count directly and proportionately affect the final degree of elasticity or stiffness of said double welt (and, if it is the case, other parts of the manufactured item). Similar examples of partial stiffening of at least a fabric area on the front portion of the breast (or other zone) are schematically shown in said FIGS. 2*a*–3*a*–4*a*, characterized in that between the loops M and M1 the usual knitting process is interrupted, said fabric being replaced by said floating yarns FF, variously placed or knitted.

FIG. 2 schematically shows a generic bra 1 designed and carried out according to the invention, provided with shoulder straps SS, SD structurally and functionally connected to various underlying zones, and with double welts 2 and 3 connected one to the other by fabric areas or zones indicated with numbers 10-11-12-13-14, stiffened thanks to the presence of a plurality of frills Bi.

F1 and F2 indicate the central areas which undergo a further stiffening by introducing said floating yarns variously handled.

In the more realistic bra 1 of FIG. 4, the structural and functional connection between the welts 2 and 3 and adjacent stiffer fabric areas, indicated with Bi, is more evident. The part corresponding to the breasts, on the contrary, is produced with usual jersey fabric MJ, whose amount is higher than the adjacent fabric zones Bi, so that said fabric can better shape onto said portions. By the way, it should be observed that the fabric part between the breasts, generally indicated with numeral 4 in FIGS. 1–2–5 is also anatomically shaped according to the teachings of the present invention; some frills Bi, placed in the middle of the breast preferably in decreasing or graduated order, define and model the fabric cups for the breasts. FIGS. 5 and 6 show other two preferred embodiments within the framework of the invention, related to tubular knitwear items which are more complex than a simple bra, strongly characterized by a large plurality of frills Bi which effectively modify the usual appearance of jersey.

In FIG. 5 the manufactured item can indifferently represent a generic vest-bra or other ladies' garment to be worn on the bust or trunk with the additional advantage of an anatomic breast support. As an alternative to said traditional shoulder straps, similar functions are carried out by the part of fabric connecting the breast to the shoulders indicated with SD-SS. FIG. 6 shows a sectioned variant of said item 1: a sleeveless vest-bra with a lower welt 3 both in usual jersey fabric and stiffened or aesthetically modified with said inner frills Bi.

The FIGS. from 7 to 16 graphically show some textile structures at the basis of the invention, together with other structures which are common in knitting technologies. In particular FIG. 10 shows a so-called "embossed" or cellular knitted structure, characterized by an alternated and prolonged sequence of tuck stitches to obtain a higher dimensional stiffening of the fabric.

FIGS. 18 to 23 show peculiar features of some preferred embodiments according to the present invention.

FIG. 18 shows men's pants 1, broadly characterized by the presence of said frills Bi, which, suitably placed on the whole manufactured item but for the inguinal portion, indirectly produce an anatomic shaping of said portion, said shaping being produced only with an elongated structure of jersey fabric MJ.

FIG. 19 shows a section view of generic pants 1, designed and manufactured to accentuate by shaping the back part made only of jersey fabric MJ, the latter being wider than the front part, formed by a plurality of frills Bi placed along the whole height of the manufactured item. In particular, the welt or elastic belt 2 shows from the right side to the left side of the figure a variable height increasing towards the back part.

This result is variously obtained during the manufacture of said welt 2: by suitably and gradually programming the thickness of fabric produced with the stitch knitting cams, the latter being controlled by a computer which is part of the equipment; or by reducing the number of needles operating in the knitting process, above all in the part of the needle cylinder indicated with A (for instance by a selection of needles with sequences of 2:2, i.e. 3:1, or 1:1 and the like). Another preferred embodiment relates to the manufactured item 1 of FIG. 20, which is particularly suitable for pregnant women, designed and produced with zones of stiff fabric 10 and 11, which are structurally and functionally connected one to other and to the welts 2 and 3.

This garment consists of two continuously produced concentric fabrics, the inner one having the function of pants, whereas the outer fabric 41, broader and with variable length, color, yarn, structure (also open-work) and/or double welt 3*a*, covers, even only partially, the underlying inner fabric, or vice versa. Then a part of said knitted tube is folded inside or outside onto the other one, thus forming an original manufactured item consisting of two layers or fabrics.

Moreover, the ventral zone ZV is further characterized by open-work knitted structures T, i.e. a plurality of holes with variable width, preferably obtained with the so-called open-work, produced by transferring lateral or opposed stitches by means of sinkers, additional needle bed or special needles (not shown). As an alternative, a textile result similar to open work is obtained by a sequence of stitches being continuously discharged and taken up with small groups of needles suitably spaced, according to the jacquard design or work cycle, after the intervention of the latch-opening device. Said open-work fabric T has the main purpose of expanding gradually and comfortably. A similar, though more effective, result can be obtained by means of suitable openings with variable size or dimensions AC, produced by combining the open-work technique with the production of said frills Bi, though using a larger number of adjacent needles gathered into groups; with simple or double edges or welts, manufactured in compliance with the technique described and shown in FIGS. 8–9–14, and with the adoption for the last knitted courses of knitted structures which are more resistant to runs, such as the so-called non-run type, characterized by the so-called "tuck stitches" and "welts", which are terms of textile vocabulary, graphically shown in FIGS. 12–13–15; preferably with the additional use of a particular thermo-adhesive yarn, which partially melts interlocking with the adjacent knitted loops during the hot stage of the following finishing process. Considering the inevitable change in the ventral circumference of pregnant women, the welt 2, even non elastic, shows a central opening AC automatically produced with the described technique, so as to introduce successively an additional belt or lace L (L1, inside).

A peculiarity of this manufactured item, which is obviously more complete and complex than simple pants, consists in that it is preferably formed by two concentric layers or fabrics, the outer one 41, also highly wider and more comfortable, being also used to cover the underlying part, i.e. the open-work fabric T or the openings AC. The production of said manufactured item preferably begins from the outer layer 41, corresponding to arrow F, with the double welt 3*a*, and goes on following the arrows as far as the upper double welt 2 together with the underlying fabric, and ends with the inner welt 3. Considering technical and commercial changes or needs, said manufactured item can be indifferently produced in the shapes and functions of pants, skirt, trousers, and more.

In simpler embodiments, i.e. two concentric tubes, the manufactured item is completed directly in the machine, without further cutting or sewing operations.

Another preferred embodiment of the invention relates to the knitwear item 1 in FIG. 21, which is also characterized by wide zones of stiffer fabric due to the presence of suitable inner frills Bi suitably placed. A peculiarity is represented by the upper double welt 2, which is interrupted and therefore incomplete on the front part DB for several purposes: to differentiate the final appearance of the item with aesthetic and commercial advantages and to implement its functionality as far as wearability is concerned. This result is due to the fact that during the initial make-up of the fabric, the dial jacks which are placed on the zone DB, are not engaged, and the corresponding needles, not being connected to said dial jacks, produce a frill Bi or said floating yarns FF, variously described and knitted. The abdominal zone ZV can be indifferently produced with jersey fabric MJ wider than the adjacent one, so as to obtain a higher anatomic shaping, or with the frills Bi for local control and support. In the specific case said abdominal zone is virtually divided into four sections, each of which can be characterized by knitted structures which are also highly different in thickness, elasticity, fiber and color according to different production requirements. The pants 1, in section in FIG. 22, beyond representing a development of other items which have already been described, distinguishes itself further since it combines in a typical way the peculiarities of the present invention: on the one hand, the general textile frame formed by the wide zone 12 extending vertically on the hips, thus connecting structurally the horizontal welts 2 and 3; on the other hand, the specific anatomic shaping corresponding to the front 11 and back 10 zone, which are clearly redundant with respect to the hatched vertical lines delimiting the welts 2 and 3. By the way, also in this manufactured item, just as in the one previously shown in FIG. 21, the height of the upper welt 2 is variable in increasing order, but towards the front part. Said zones 10 and 11 are produced with a fabric thickness which is gradually wider with respect to the adjacent jersey fabric, both indicated with MJ and obviously different in the dimensions of the individual stitches or loops. Finally, FIG. 23 represents a schematic section view of a preliminary plan for a possible manufactured item 1, initially divided into numbered areas or zones, which have variable dimensions and location. Each zone can be designed and connected to the adjacent zones according to technical, aesthetical, commercial and functional needs. For instance, the trousers of a tracksuit (not shown) for sports activity can be designed by dividing the manufactured item into three horizontal sections corresponding more or less to pelvis, thighs and calves. By suitably varying the count, quality and amount of yarn, also elastomeric yarn, together with suitable knitted structures such as the frills Bi, it is possible to produce three fabric areas with differentiated elasticity and compression according to configurations and possible muscular stresses from the user. With particular reference to the tubular items described or shown, considering the dictates of fashion and other variables affecting consumers' choices, the present invention proposes and claims also the creation of inside-out knitwear items, i.e. designed and carried out so as to point out the three-dimensional effects of the so-called inner frills Bi, which, placed outside and possibly opened or crumpled, produce an original variety of valuable textile, aesthetic and functional effects. The same can be said for the tubular items with two concentric layers as described, which can be worn and shown both normally and inside out, if one wants to stress the transparent effect between the bottom fabric, which is substantially different from the one lying above as far as yarn, color or structure are concerned, and the top fabric consisting also of said "open-work" or transparent structures.

The present description, though necessarily limited, provides people skilled in the art with wide possibilities of novelty falling within the framework of the invention.

What is claimed is:

1. A method for producing automatically shaped tubular knitwear items (1) with graduated anatomic support and control, in circular knitting machines provided with at least a needle-bed, characterized in that it comprises the following steps:

excluding a predetermined number of needles (A) chosen according to a predetermined sequence in at least a first portion of said needle-bed; and producing a first length of tubular knitted fabric including at least: a first zone of said first length of tubular knitted fabric, said first zone corresponding to said first portion of the needle-bed, said first zone having a differentiated growth of knitted courses with exceeding stitches or inner frills (Bi), said differentiated growth providing a stiffened fabric structure; and a second zone of said first length of tubular knitted fabric, said second zone corresponding to a remaining portion of the needle-bed, thus obtaining a programmed three-dimensional deformation of the knitted tube, said first zone having a lower structural elasticity than said second zone.

2. The method according to claim 1, characterized in that it further comprises, before the step of excluding from the knitting process a predetermined number of needles (A), the step of producing a second length of tubular fabric having a cylindrical shape.

3. The method according to claim 1, characterized in that it further comprises the step of reintroducing, after a predetermined time interval, said predetermined number of needles (A) of the needle-bed in the knitting process and producing a third length of tubular knitted fabric.

4. The method according to claim 3 characterized in that said steps of excluding a predetermined number of needles (A), producing a first length of tubular fabric and reintroducing said predetermined number of needles (A) in the knitting process, are repeated during the knitting process of a knitted tube by progressively excluding and reintroducing in the knitting process different predetermined numbers of needles (A) chosen in different portions of the needle-bed for each knitted course.

5. The method according to claim 4 in which each different portion of the needle-bed, from which is chosen the predetermined number of needles (A) to be excluded, is selected, for each knitted course, adjacent to preceding portion, in order to obtain frills (Bi) disposed transversally along the knitted tube.

6. The method according to claim 1, characterized in that in said in step of excluding from the knitting process a predetermined number of needles (A), the excluded needles (A) are chosen from at least two separated portions of said needle-bed, corresponding at least to said first and said second zone of the knitted tube, according to a predetermined sequence for each separate portion of the needle-bed.

7. The method according to claim 1 characterized in that it is carried out with the continuous motion of the needle cylinder, said items (1) being provided with one or more knitted areas with inner frills (Bi) which are structurally and functionally connected to control and support, together, the concerned anatomic portions.

8. The method according to claim 7 characterized in that it comprises the step of producing one or more of said areas of the knitted tube with embossed or cellular structures, to make these knitted areas dimensionally stiffer than the adjacent one.

9. The method according to claim 7, characterized in that said circular machine is equipped with a second bed or dial with additional jacks or needles (A), and in that said tubular items (1) are shaped or modeled, by producing a fabric with differentiated growth of courses or loops or pre-defined areas by means of the programmed exclusion, even partial, of loops or knitted courses and the simultaneous production, even partial, of exceeding stitches or inner frills (Bi), according to the jacquard design or to the corresponding work cycle of the textile machine.

10. The method according to claim 1 characterized by the exclusion of a reduced number of needles (A) with respect to the total number of needles (A) housed in the corresponding bed, alternated with respect to the adjacent ones.

11. The method according to claim 10, characterized in that during the knitting process a great part of inputs or commands directed to the needles (A) is not sent to a part of the latter, even for a long time, following a jacquard design or work cycle.

12. The method according to claim 1 characterized in that it comprises the step of introducing automatically in the fabric one or more laid-in or floating yarns, which can also be introduced and cut, to obtain a higher structural stiffness in the direction of knitted courses.

13. The method according to claim 1 characterized in that it further comprises the step of producing at least an initial double welt (2) of variable height, by reducing the number of needles operating in the knitting process in at least a first portion of said needle-bed.

14. The method according to claim 13 characterized in that it further comprises the step of providing an opening (AC) in said initial double welt by excluding from the knitting process a predetermined number of adjacent needles (A) chosen in a corresponding portion of said needle-bed.

15. The method according to claim 1 characterized in that it further comprises the steps of:

producing an initial double welt (2), also variable in height, followed by a suitable number of knitted courses; and producing a second double welt (3) followed by a final waste or unthreading; said knitted courses being at least partly produced in compliance with a design or pattern and corresponding work cycle in which a part of the needles (A), whose extension is less than 360 degrees of the needle cylinder, is excluded from the knitting process, whereas the other alternated needles (A), which are still operating, produce loops forming frills (Bi) within the knitted tube.

16. The method according to claim 1, characterized in that at the end of said frills (Bi) the corresponding needles (A) completely discharge the last loops of the frills (Bi), according to a jacquard design or operating program or work cycle, in order to obtain open or crumpled frills (Bi).

17. The method according to claim 16, characterized in that the complete discharge of the last loops by part of the needles (A) is carried out only progressively in at least a feed without yarn, at least temporarily.

18. The method according to claim 16, characterized in that after the discharge of the last loops, the knitting process of said needles (A) is preceded by the intervention of latch-opening devices and begins again only progressively with selected alternated needles (A), in at least a feed provided with yarn.

19. The method according to claim 1 characterized in that it comprises the steps of producing two concentric layers, joined by at least a common double welt (2), also closed by transferring loops with suitable needles (A) or jacks housed in the dial or additional needle-bed.

20. The method according to claim 19 characterized in that it further comprises the steps of producing several closed layers and introducing automatically between said closed layers, during the production process, floating.

21. Knitwear item (1) as obtainable by a process according to claim 1 characterized in that it is designed and carried out also inside out, so as to stress the three-dimensional effects of inner frills (Bi).

22. Knitwear item (1) as obtainable by a process according to claim 1, preferably for sports and agonistic activities, characterized in that it is divided into several sections corresponding to different anatomic portions, so as to produce knitted zones with differentiated elasticity and compression according to configurations and possible athletic stresses, by suitable varying the count, quality and amount of yarn, even an elastomeric yarn, together with suitable knitted structures such as the suitable placed frills (Bi).

23. Knitwear item (1) as obtainable by a process according to claim 1, having one or more layers and characterized by the simultaneous presence of front and reverse knitted zones.

24. Knitwear item (1) as obtainable by a process according to claim 1, with two layers, characterized in that the top or outer fabric is at least partially made of so-called "openwork" or "look through" knitted structures, therefore distinguishing from the substantially different underlying fabric.

25. Knitwear item (1) as obtainable by a process according to claim 1, characterized by one or more zones with open work (T) and central openings (AC).

26. Knitwear item (1) as obtainable by a process according to claim 1, such as a T-shirt and the like, characterized by the presence of stiffer areas having additional functions of anatomic breast support.

* * * * *